US007201228B2

(12) United States Patent
Robb et al.

(10) Patent No.: US 7,201,228 B2
(45) Date of Patent: Apr. 10, 2007

(54) FREER FLOWING LIQUID-SOLID SUSPENSIONS AND METHODS OF USE IN SUBTERRANEAN FORMATIONS

(75) Inventors: Ian D. Robb, Duncan, OK (US); Ronnie G. Morgan, Waurika, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 29 days.

(21) Appl. No.: 10/929,956

(22) Filed: Aug. 30, 2004

(65) Prior Publication Data

US 2006/0042836 A1 Mar. 2, 2006

(51) Int. Cl.
*E21B 43/26* (2006.01)

(52) U.S. Cl. ..... 166/308.1; 166/280.2

(58) Field of Classification Search ..... None
See application file for complete search history.

(56) References Cited

U.S. PATENT DOCUMENTS 4,478,282 A * 10/1984 Nolte et al. ..... 166/281
5,492,178 A * 2/1996 Nguyen et al. ..... 166/276
5,826,669 A 10/1998 Zaleski et al. ..... 175/72
6,357,527 B1 * 3/2002 Norman et al. ..... 166/300
6,575,692 B2 6/2003 Vatne et al. ..... 414/803
6,599,863 B1 * 7/2003 Palmer et al. ..... 507/219

OTHER PUBLICATIONS

Clyde Orr, "Particulate Technology," (MacMillan 1966), at p. 13.
Ronald Darby, "Viscoelastic Fluids," (Marcel Dekker ed. 1976), at p. 66.

* cited by examiner

*Primary Examiner*—Zakiya W. Bates
(74) *Attorney, Agent, or Firm*—Robert A. Kent; Baker Botts

(57) ABSTRACT

The invention relates to methods for improving the suspension of solids in liquids; more particularly, to reducing the potential stresses caused by increased particle loading in a fluid. An example of a method is a method of enhancing the flow of particles. Another example of a method is a method of fracturing a subterranean formation. Another example of a method is a method of gravel packing a portion of a subterranean formation. Another example of a method is a method of enhancing the flow of drill cuttings. An example of a composition is a treatment fluid comprising a liquid component and a solid component.

10 Claims, 3 Drawing Sheets

FREER FLOWING LIQUID-SOLID SUSPENSIONS AND METHODS OF USE IN SUBTERRANEAN FORMATIONS

BACKGROUND

The present invention relates to methods for improving the suspension of solids in liquids. More particularly, the present invention relates to methods that may be used to reduce the potential stresses caused by increased particle loading in a fluid.

Treatment fluids comprising solid particles often are used in a variety of operations performed in subterranean formations. Such operations include, but are not limited to, production stimulation operations (e.g., hydraulic fracturing) and well completion operations (e.g., gravel packing).

In a hydraulic fracturing operation, a type of treatment fluid, often referred to in the art as a fracturing fluid, is placed in a subterranean formation at a rate and pressure sufficient to create or enhance at least one fracture in the formation. The resultant fracture or fractures may be horizontal or vertical, with the latter usually predominating, and with the tendency toward vertical fractures generally increasing with the depth of the formation being fractured. Fracturing fluids generally are viscosified fluids, gels, emulsions, or foams that may comprise particles that often are referred to as "proppant particles." Proppant particles are deposited in the fractures and function, inter alia, to maintain the integrity of the fractures, and thereby potentially enhance the conductivity of the formation.

In a gravel packing operation, particles referred to in the art as "gravel" are carried to a portion of a well bore penetrating a subterranean formation by a carrier fluid, inter alia, to reduce the migration of unconsolidated formation solids into the well bore. The carrier fluid may be viscosified, inter alia, to enhance certain properties (e.g., particle suspension). Once the gravel has been placed into a pack in the well bore or in a portion of the subterranean formation, the viscosity of the carrier fluid may be reduced, whereupon it may be returned to the surface and recovered. Gravel packs often are used to stabilize the formation while causing minimal impairment to well productivity. While screenless gravel packing operations are becoming increasingly common, traditional gravel pack operations commonly involve placing a gravel pack screen in the well bore neighboring a desired portion of the subterranean formation, and packing the surrounding annulus between the screen and the well bore with gravel that is sized to prevent and inhibit the passage of formation solids through the gravel pack with produced fluids. The gravel pack screen is generally a filter assembly used to support and retain the gravel placed during the gravel pack operation. A wide range of sizes and screen configurations are available to suit the characteristics of the well bore, the production fluid, and the portion of the subterranean formation. The gravel, inter alia, acts to prevent the solids from occluding the screen or migrating with the produced fluids, and the screen, inter alia, acts to prevent the gravel from entering the well bore.

Occasionally, an operator may choose to combine the processes of hydraulic fracturing and gravel packing into a unified treatment that may stimulate production while providing an annular gravel pack for sand control. Such treatments often are referred to as "frac pack" operations. Frac pack operations may be conducted with a gravel pack screen assembly in place, by pumping the fracturing fluid through an annular space between the screen and casing (or between the screen and the walls of the well bore, in "open hole" wells that are completed without casing). In such case, the frac pack operation ultimately may terminate in a condition referred to as "screen out" that creates an annular gravel pack between the screen and casing (or between the screen and the well bore walls, in open hole wells). This allows both fracturing and gravel packing to be performed in a single operation. In other cases, the fracturing treatment may be performed prior to the installation of the screen and placement of the gravel pack.

In these and other operations involving a particle-laden treatment fluid, an upper limit may exist as to the optimum amount of particles that can be suspended and successfully carried in the treatment fluid. The flow of dispersions of particles in a liquid may become increasingly difficult as the volume fraction of particles increases, e.g., both the steady shear viscosity and the residual stress within the dispersion may increase as the volume fraction of particles increases. The increase in steady shear viscosity and/or residual stress generally is not linear; rather, it generally increases as the solids content approaches maximum packing (for fluids having a particle size distribution that is monodisperse, maximum packing of solids is known to be about 66% by volume of the dispersion). During the flow of concentrated dispersions of solids through a container or channel (e.g., a laboratory test tube or a subterranean fracture), the solid particles may form bridges across the inner diameter of the container or channel, thereby blocking or impairing the flow. This tendency to form bridges may increase as residual stress within the dispersion increases.

When this phenomenon occurs during a conventional subterranean treatment operation, e.g., a fracturing operation involving the use of a proppant-laden fracturing fluid, this undesirable bridging of proppant particles across the width of a fracture in a formation may tend to prematurely halt the deposition of proppant within the fracture. This bridging may block further flow of fracturing fluid into the fracture (thereby preventing continued propagation of the fracture). In other cases, the fracturing fluid may succeed in flowing around the blockage, and may continue (without the proppant) to penetrate into the formation, thereby continuing to propagate the fracture for a time. In this latter case, however, the portion of the fracture that extends beyond the bridged proppant particles generally will lack proppant, and likely will undesirably re-close shortly after the termination of the fracturing operation, because it may lack the support necessary to maintain its integrity.

Previously in the art, operators have added polymers such as xanthan to the treatment fluid to help alleviate the stresses that may be caused by increased particle loading. Such polymers are believed to aid in maintaining an even distribution of suspended particles. However, elevated pumping pressure may be required, which may increase the cost and complications associated with the treatment operation. Another known method for combating stresses that may be caused by increased particle loading involves adding a gas phase to the treatment fluid, thereby "foaming" the fluid. The presence of a gas phase is believed to aid in reducing contact between neighboring suspended particles. However, introduction of a gas phase may create an added expense for an operator, and may be problematic when the treatment fluid is to be placed in a high pressure well.

Until recently, reliable testing of the effect of these stress-reducing techniques has been problematic due to the fact that existing rheometers have been unable to measure to a desired accuracy the viscosity and residual stress in a fluid having a high concentration of solids. The recent invention of a rheometer capable of taking such measurements has spurred research directed, inter alia, to the art of reducing stresses that may be caused by increased particle loading in a fluid.

SUMMARY

The present invention relates to methods for improving the suspension of solids in liquids. More particularly, the present invention relates to methods that may be used to reduce the potential stresses caused by increased particle loading in a fluid.

An example of a method of the present invention is a method of enhancing the flow of particles comprising: providing a substantially monodisperse volume of macro-particles; adding a viscosified liquid to the volume of macro-particles to create a macro-particle slurry; providing a volume of micro-particles that have an average diameter at least about 20 times smaller than that of the macro-particles, the volume of micro-particles being from about 1% to about 20% of the volume of macro-particles; and adding the volume of micro-particles to the macro-particle slurry.

Another example of a method of the present invention is a method of fracturing a subterranean formation comprising: placing a treatment fluid comprising a liquid component and a solid component into a subterranean formation at a pressure sufficient to create or enhance at least one fracture therein, wherein: the solid component comprises: a portion of macro-particles; and a portion of micro-particles that have an average diameter at least about 20 times smaller than that of the macro-particles; the portion of micro-particles comprises about 1% to about 20% of the total volume of the solid component; and the portion of macro-particles comprises about 80% to about 99% of the total volume of the solid component.

Another example of a method of the present invention is a method of gravel packing a portion of a subterranean formation, comprising: contacting the portion of the subterranean formation with a treatment fluid comprising a liquid component and a solid component so as to form a gravel pack in or neighboring the portion of the subterranean formation, wherein: the solid component comprises: a portion of macro-particles; and a portion of micro-particles that have an average diameter at least about 20 times smaller than that of the macro-particles; the portion of micro-particles comprises about 1% to about 20% of the total volume of the solid component; and the portion of macro-particles comprises about 80% to about 99% of the total volume of the solid component.

Another example of a method of the present invention is a method of enhancing the flow of drill cuttings comprising: providing a drilling fluid; using the drilling fluid to drill into a subterranean formation and produce drill cuttings; and adding micro-particles to the drilling fluid, the micro-particles having an average diameter at least about 20 times smaller than that of the drill cuttings, and the micro-particles being present in the drilling fluid in an amount in the range of from about 1% to about 20% by volume of the drill cuttings produced.

An example of a composition of the present invention is a treatment fluid comprising a liquid component and a solid component, the solid component comprising a portion of macro-particles and a portion of micro-particles, the micro-particles having an average diameter at least about 20 times smaller than that of the macro-particles; wherein the portion of micro-particles comprises about 1% to about 20% of the total volume of the solid component; and the portion of macro-particles comprises about 80% to about 99% of the total volume of the solid component.

Other and further features and advantages of the present invention will be readily apparent to those skilled in the art upon a reading of the description of preferred embodiments that follows.

BRIEF DESCRIPTION OF THE DRAWINGS

A more complete understanding of the present disclosure and advantages thereof may be acquired by referring to the following description taken in conjunction with the accompanying drawings, wherein.

Figure 1:
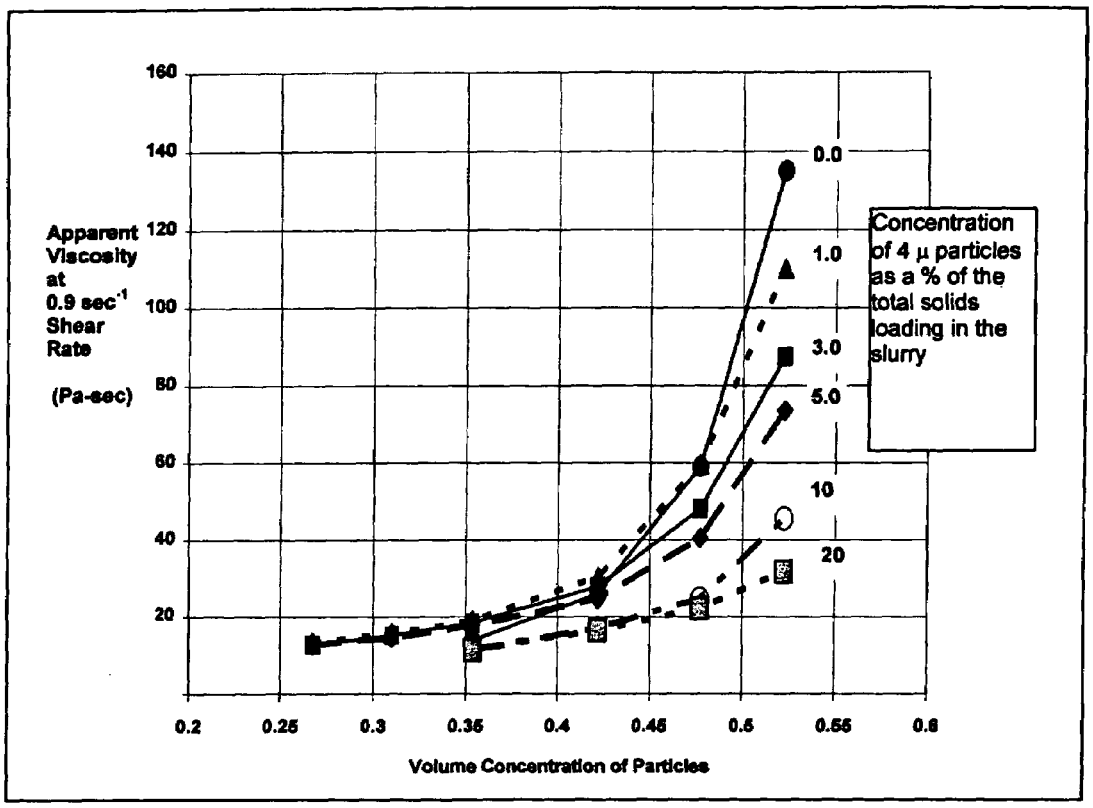
FIG. 1 is a graphical representation of the apparent viscosity demonstrated by embodiments of treatment fluids that comprised only dispersions of macro-particles, and embodiments of treatment fluids of the present invention that comprised dispersions of both macro- and micro-particles.

While the present invention is susceptible to various modifications and alternative forms, specific embodiments thereof have been shown in the drawings and are herein described. It should be understood, however, that the description herein of specific embodiments is not intended to limit, or to define, the invention to the particular forms disclosed, but on the contrary, the intention is to cover all modifications, equivalents, and alternatives falling within the spirit and scope of the invention as defined by the appended claims.

DETAILED DESCRIPTION OF EMBODIMENTS

The present invention relates to methods for improving the suspension of solids in liquids. More particularly, the present invention relates to methods that may be used to reduce the potential stresses caused by increased particle loading in a fluid. While the compositions and methods of the present invention are useful in a variety of subterranean applications, they may be particularly useful in subterranean treatment operations (including gravel packing, fracturing, and frac-packing operations) that utilize carrier fluids containing particles. Certain embodiments of the present invention also may be useful in other fields, including, but not limited to, the unloading of solids from the hold of a ship.

Where solids slurried into a liquid are all of the same approximate size, the slurry may be termed "monodisperse." In the compositions and methods of the present invention, when the solids slurried into a liquid are of disparate sizes, the resultant slurries may be characterized as "polydisperse." While it has been known in the art that a polydisperse slurry may be laden with a greater percentage of solids than a monodisperse slurry, it recently has been discovered that the percentage of solids loading in a slurry further may be increased through the present invention, without impairing the slurry's flow characteristics (e.g., viscosity, yield point, or residual shear stress remaining in a dispersion of solids after the cessation of shear). The present invention achieves this and other improvements by providing a treatment fluid that comprises a polydisperse slurry comprising a solid component that comprises a first portion and a second portion of substantially spherical particles, wherein the first portion comprises macro-particles, and wherein the second portion comprises micro-particles that have an average diameter of at least about 20 times smaller than that of the macro-particles. In certain embodiments of the present invention, the portion of micro-particles comprises about 1% to about 20% of the total volume of the solid component in the slurry, and the portion of macro-particles comprises about 80% to about 99% of the total volume of the solid component in the slurry. As referred to herein, the term "spherical" will be understood to designate particles having an average ratio of minimum diameter to maximum diameter of at least about 0.7 or greater.

The treatment fluids of the present invention generally comprise a liquid component and a solid component. Where the methods and treatment fluids of the present invention are used in subterranean applications, the liquid component may be any treatment fluid, including, inter alia, viscosified treatment fluids, foams, aqueous gels, emulsions, and other fluids suitable for transporting solids. Where the liquid component comprises an aqueous gel, the aqueous gel generally comprises water and one or more gelling agents, which may gel the water, thereby increasing its viscosity. Where the liquid component comprises an emulsion, the emulsion may comprise two or more immiscible liquids; for example, the emulsion may comprise an aqueous gel and a liquefied, normally gaseous fluid (e.g., carbon dioxide). In one embodiment of the present invention, the treatment fluid may be an aqueous gel comprising water, a gelling agent, and, optionally, a crosslinking agent that crosslinks the aqueous gel; the presence of the optional crosslinking agent further may increase the viscosity of the treatment fluid, which further may affect the treatment fluid's ability to suspend solids. In certain embodiments, it may be desirable to increase the viscosity of a treatment fluid so as, inter alia, to reduce fluid loss into the subterranean formation and reduce the sedimentation of suspended particles. Generally, the liquid component may be present in the treatment fluids of the present invention in an amount in the range of from about 45% to about 97% by volume, when measured at the surface, prior to placement of the treatment fluid in a subterranean formation.

The solid component present in the treatment fluids of the present invention typically comprises a first portion and a second portion of substantially spherical particles, wherein the first portion comprises macro-particles, and wherein the second portion comprises micro-particles that have an average diameter at least about 20 times smaller than that of the macro-particles. Generally, the solid component is present in the treatment fluids of the present invention in an amount in the range of from about 3% to about 55% by volume, when measured at the surface, prior to placement of the treatment fluid in a subterranean formation. Any particulate material suitable for use in subterranean applications may be suitable for use as macro-particles. For example, natural sand, quartz sand, particulate garnet, glass, ground walnut hulls, nylon pellets, bauxite, ceramics, inorganic crystals (e.g., calcium carbonate), polymeric materials, or the like may be suitable. Suitable sizes for a macro-particle generally range from about 4 to about 100 U.S. mesh. In certain embodiments, a macro-particle may be used that has a size in the range of from about 10 to about 70 U.S. mesh. Generally, a macro-particle may be used that has an average diameter at least about 20 times as large as that of the micro-particle. In certain embodiments of the present invention, the portion of micro-particles comprises about 1% to about 20% of the total volume of the solid component in the treatment fluid, and the portion of macro-particles comprises about 80% to about 99% of the total volume of the solid component in the treatment fluid. A broad variety of particulate materials that are suitable for use in subterranean applications may be suitable for use as the at least one micro-particle, including, but not limited to, silica, alumina, calcite, and other inorganic crystals or metal oxides.

The sizes of several types of particles, including those present in the solid component of the treatment fluids of the present invention, may be characterized using, inter alia, the Log Mean Diameter (LMD). One may calculate the LMD of a grouping of particles from a histogram of the fraction of particles having a certain diameter. The method for this is well known to those skilled in the art, and is illustrated in "Particulate Technology," by Clyde Orr (MacMillan 1966), at page 13. For example, the LMD of a system may be calculated from particle size distributions measured on a Malvern Master Sizer. Though an "average diameter" may be determined for the particles of any bulk solid, the individual particles of the bulk solid generally exist in a range of sizes, including a portion of "fines" that may have a diameter about 20 times smaller than the "average diameter" of the bulk solid. Though such fines may be present in the solid components of the treatment fluids of the present invention, the concentration of fines having the desired size (e.g., at least about 20 times smaller than the average diameter) generally will be sufficiently small that the fines will not impact the physical properties of the treatment fluids of the present invention.

Optionally, the treatment fluids of the present invention also may include one or more of a variety of well-known additives such as breakers, stabilizers, fluid loss control additives, clay stabilizers, bactericides, and the like.

The treatment fluids of the present invention may be used in subterranean operations such as, but not limited to, fracturing and/or gravel packing. In such operations, the solid component of the treatment fluids of the present invention generally will be placed within a subterranean formation as, e.g., a proppant pack or a gravel pack. After placement, a portion of the liquid component of the treatment fluids of the present invention generally will be recovered from the formation. When used in such subterranean operations, the presence of the micro-particles in the solid component of the treatment fluids of the present invention may impart a lubricating effect upon the macro-particles as the treatment fluids of the present invention flow within the subterranean formation. This lubricating effect may reduce the viscosity or yield point of a proppant pack or gravel pack during, or after its placement in the formation by the treatment fluids of the present invention. Further, this lubricating effect may permit a treatment fluid of the present invention comprising a dispersion of micro- and macro-particles to penetrate further into a subterranean formation during a treatment operation, thereby increasing the amount of solids that a treatment fluid of the present invention successfully may deposit within the formation.

In certain embodiments, the methods of the present invention may be used to facilitate the loading and unloading of solids to and from transport vessels, e.g., ships. Bulk carriers and unloading systems are disclosed in U.S. Pat. No. 6,575,692, the relevant disclosure of which is hereby incorporated by reference. For example, an operator desiring to load solids into the hold of a barge may elect to add a quantity of micro-particles to the solids to be loaded in accordance with the methods of the present invention, and thereby enhance the rate at which the solids may be loaded.

An example of a method of the present invention is a method of enhancing the flow of particles comprising: providing a substantially monodisperse volume of macro-particles; adding a viscosified liquid to the volume of macro-particles to create a macro-particle slurry; providing a volume of micro-particles that have an average diameter at least about 20 times smaller than that of the macro-particles, the volume of micro-particles being from about 1% to about 20% of the volume of macro-particles; and adding the volume of micro-particles to the macro-particle slurry. In certain embodiments, the viscosified liquid may further comprise a viscosifying agent (e.g., xanthan, guar or guar derivatives, and cellulose derivatives) that may aid in suspending the macro-particles and micro-particles, thereby enhancing the uniformity of the suspension. In certain embodiments of the present invention, a portion of the viscosifying agent may be present in the treatment fluid as a gel, or a semi-solid.

Another example of a method of the present invention is a method of fracturing a subterranean formation comprising: placing a treatment fluid comprising a liquid component and a solid component into a subterranean formation at a pressure sufficient to create or enhance at least one fracture therein, wherein: the solid component comprises: a portion of macro-particles; and a portion of micro-particles that have an average diameter at least about 20 times smaller than that of the macro-particles; the portion of micro-particles comprises about 1% to about 20% of the total volume of the solid component; and the portion of macro-particles comprises about 80% to about 99% of the total volume of the solid component. In certain embodiments, the portion of the solid component deposited within the fracture will have a viscosity and yield point that is less than the solid component would have had, in the absence of micro-particles.

Another example of a method of the present invention is a method of gravel packing a portion of a subterranean formation, comprising: contacting the portion of the subterranean formation with a treatment fluid comprising a liquid component and a solid component so as to form a gravel pack in or neighboring the portion of the subterranean formation, wherein: the solid component comprises: a portion of macro-particles; and a portion of micro-particles that have an average diameter at least about 20 times smaller than that of the macro-particles; the portion of micro-particles comprises about 1% to about 20% of the total volume of the solid component; and the portion of macro-particles comprises about 80% to about 99% of the total volume of the solid component. In certain embodiments, the gravel pack will have a viscosity and yield point that is less than the solid component would have had, in the absence of micro-particles.

Another example of a method of the present invention is a method of enhancing the flow of drill cuttings comprising: providing a drilling fluid; using the drilling fluid to drill into a subterranean formation and produce drill cuttings; and adding micro-particles to the drilling fluid, the micro-particles having an average diameter at least about 20 times smaller than that of the drill cuttings, and the micro-particles being present in the drilling fluid in an amount in the range of from about 1% to about 20% by volume of the drill cuttings produced.

To facilitate a better understanding of the present invention, the following examples of some of the preferred embodiments are given. In no way should such examples be read to limit, or to define, the scope of the invention.

EXAMPLE 1

Sample compositions comprising aqueous dispersions of unsieved silica particles having diameters in the range of from about 40μ to about 300μ were prepared by dispersing the sieved powders by hand, using a spatula, into a 1% solution of carboxymethyl hydroxylpropylguar until the dispersion was visibly uniform. The sample compositions then were tested according to the following procedure.

Figure 3:
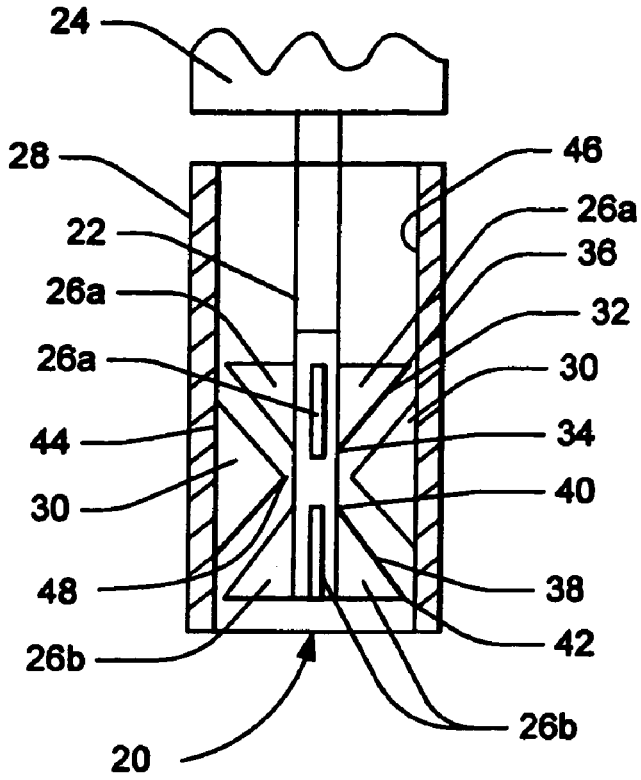
FIG. 3 is a sectioned elevational view of one embodiment of a modified sleeve and modified bob of a yield stress adapter.
Figure 4:
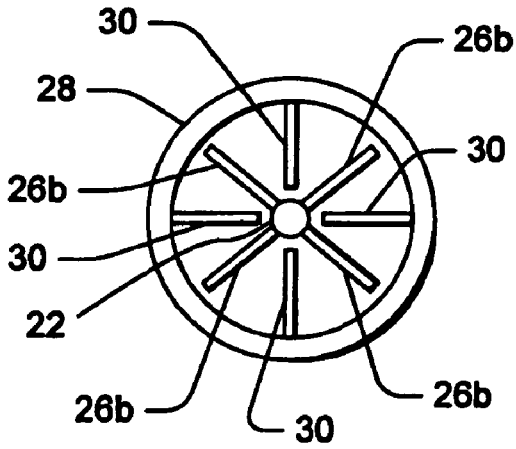
FIG. 4 is an end view of the embodiment shown in FIG. 3.

The sample compositions first were placed into an apparatus that comprised a modified bob and sleeve that was attached to a Fann 35 rheometer. An example of the modified bob and sleeve is disclosed in commonly-owned U.S. patent application Ser. No. 10/354,846. The modified bob and sleeve comprises a plurality of intermeshing fins. Such an arrangement previously has been shown to provide, inter alia, an accurate measurement of the viscosity or residual stress of concentrated slurries of dispersions of solids. More particularly, the apparatus comprised a rotating viscometer that included a driven portion, a responsive body, a "standard" (that is, standard for a conventional Couette or rotating viscometer) spring and a plurality of fins or vanes (referred to herein as fins). These fins have predetermined shapes and are disposed in the rotating viscometer such that the rotating viscometer and the standard spring of the rotating viscometer are sensitive to detect the yield stress of a test fluid composition in response to a selected rotation imparted to the driven portion of the rotating viscometer. The standard spring of the rotating viscometer is connected to the responsive body of the rotating viscometer, which responsive body has at least a portion of the fins on it. As shown in FIGS. 3 and 4, a set of intermeshing fins or vanes are attached to a modified bob and modified sleeve that easily attach to existing Couette viscometers common in the oil field service industry, such as, but not limited to, Fann and Chandler rotating viscometers. The number, shape and position of these triangular fins provided for proper sensitivity with the standard torque springs being used in the Fann 35 and Chandler type viscometers, for example, as well as for allowable clearance between fins sufficient to allow free movement of particles.

As illustrated in FIGS. 3 and 4, the responsive body is a modified bob 20 that includes a shaft 22 connected to the standard spring inside the receptacle device 24 of the rotating viscometer. This shaft 22 has eight fins 26 disposed on it in two axially spaced groups (as indicated by suffixes "a" and "b" to the fin-designating reference numeral 26). The driven portion of the embodiment shown in FIGS. 3 and 4 includes a sleeve 28 modified in that it has four fins 30 disposed on it such that the four fins 30 on the sleeve 28 are between the two axially spaced groups of fins 26*a*, 26*b* on the shaft 22 when the shaft 22 is placed inside the sleeve 28 as illustrated in the drawings. The apparatus also provided a yield stress measurement device comprising a yield stress adapter, a motor, and a torque sensor.

Referring to FIGS. 3 and 4, each of the two axially spaced groups of fins 26*a*, 26*b* connected to the shaft 22 included a respective set of four right triangular members having two sides of equal length (isosceles). One set of these right triangular members (the group with fins 26*a* in FIG. 3) had the hypotenuse 32 of each right triangular member extending upwardly and away from the respective hypotenuse's point of contact 34 with the shaft 22 to an upper distal tip 36. The other of the two sets of these right triangular members (fins 26*b* in FIG. 3) had the hypotenuse 38 of each right triangular member extending downwardly and away from the respective hypotenuse's point of contact 40 with the shaft 22 to a lower distal tip 42. As shown in FIGS. 3 and 4, the upper distal tips 36 are substantially coplanar, and the lower distal tips 42 are substantially coplanar in a different plane from, but one parallel to, the one of the upper distal tips 36.

The group of triangular members of the sleeve 28 shown in FIGS. 3 and 4 included four right triangular members (the fins 30 for FIG. 3) having a hypotenuse 44 of each such right triangular member disposed along inner surface 46 of the sleeve 28 parallel to a longitudinal axis of the sleeve 28 such that an apex of each such right triangular member defined an inner distal tip 48. As shown in FIGS. 3 and 4, these inner distal tips 48 are substantially coplanar relative to a plane in between and parallel to those of the upper and lower distal tips 36, 42.

The apparatus was used to measure yield stress by operating a standard rotating viscometer, modified with a plurality of intermeshing fins such that a standard spring of the standard rotating viscometer responded to a torque that is related to yield stress and that was imposed by a stressed test material on a portion of the fins connected to the standard spring.

To modify a standard rotating viscometer for use in determining yield point, the standard bob and a standard sleeve of the standard rotating viscometer were replaced with a modified bob and a modified sleeve. Disposed on the modified bob and modified sleeve were a plurality of intermeshing fins such that a standard spring of the standard rotating viscometer responded to a torque that is related to yield point and that is imposed by a stressed test material on the standard spring through connection of the standard spring to the modified bob. Accordingly, the conventional sleeve was replaced with a modified sleeve having a plurality of fins extending inwardly from an inner surface of the modified sleeve, and the conventional bob was replaced with a modified bob. The modified bob was connected to the standard Couette viscometer spring, and the modified bob had fins extending outwardly as described above. Thus, the modification was completed by replacing the conventional bob and the conventional sleeve without replacing the standard Couette viscometer spring.

Each fluid sample to be tested was loaded by lowering the modified bob 20 and modified sleeve 28 into the sample, which was held in a suitable container. The modified bob 20 and the modified sleeve 28 were connected in conventional manner into the rotating viscometer in place of the bob 4 and the sleeve 2, respectively. A speed of three rpm (which corresponds to 0.9 $s^{-1}$) was selected and the motor of the motor drive 8 was turned on to rotate the modified sleeve 28 at that speed. Torque was measured via action of the spring 12 and the torque dial 14 imparted by movement of the modified bob 20 due to the stressed test fluid, and the torque readings were recorded. The motor was turned off, and residual torque was recorded for a sufficient time, during which the residual stress reading decayed to a lower equilibrium value, which was recorded as the residual stress of the particular sample composition being tested. Knowing the torque readings and the rotational speed, through a series of calibrations with Newtonian fluids of various viscosities and non-Newtonian fluids of various shear thinning indices, coefficients $k_1$ and $k_2$ were determined. The value of k2 can be determined by plotting the viscosity of at least three Newtonian standard liquids as a function of torque/rpm, whereupon the slope of the resulting line gives $k_2$. The value of $k_1$ can be determined using power law (shear thinning) standard fluids, as follows. With these power law fluids, the stress, τ, equals K' (shear rate)$^{n'}$, where K' and n' are constants characteristic of a particular power law fluid. Further information on K' and n' values for various fluids may be found on page 66 of "Viscoelastic Fluids," by Ronald Darby (Marcel Dekker ed. 1976), the relevant disclosure of which is hereby incorporated herein by reference. Then, $K'(k_1 \cdot rpm)^{n'-1}=k_2(torque/rpm)$, which permits calculation of $k_1$. This allows for accurate transformation of rpm-versus-torque data into shear-stress-versus-shear-rate data, namely:

Shear Rate (in units of 1/sec)=$k_1$×RPM, or $$\dot{\gamma}=k_1(\text{RPM}) \qquad \text{[Equation 1]}$$

Viscosity (in Pa-sec)=$k_2$×Torque reading on the dial/RPM, or $$\eta=\left[\frac{k_2(\text{Torque})}{RPM}\right] \qquad \text{[Equation 2]}$$

Shear Stress (in Pa)=$k_1$×$k_2$×Torque, or $$\tau=k_1k_2(\text{Torque}) \qquad \text{[Equation 3]}$$

Sample Compositions Nos. 1 through 4 comprised aqueous dispersions of 35%, 42.5%, 47.5%, and 52% total solids volume, respectively, in 1% carboxymethyl hydroxypropyl guar. The total solids volume entirely comprised macro-particles of silica. The apparent viscosities of Sample Compositions 1 through 4 were determined to be 15, 25, 60 and 135 Pa-second, respectively.

Sample Compositions Nos. 5 through 10 comprised aqueous dispersions of 26.5%, 31%, 35%, 42.5%, 47.5%, and 52% total solids volume, respectively, in 1% carboxymethyl hydroxypropyl guar. The total solids volume comprised 1% of a 4μ micro-particle by volume, and 99% of macro-particles of silica. The apparent viscosities of Sample Compositions 5 through 10 were determined to be 15, 17, 19, 30, 60 and 110 Pa-second, respectively.

Sample Compositions Nos. 11 through 16 comprised aqueous dispersions of 26.5%, 31%, 35%, 42.5%, 47.5%, and 52% total solids volume, respectively, in 1% carboxymethyl hydroxypropyl guar. The total solids volume comprised 3% of a 4μ micro-particle by volume, and 97% of macro-particles of silica. The apparent viscosities of Sample Compositions 11 through 16 were determined to be 15, 17, 19, 28, 48, and 88 Pa-second, respectively.

Sample Compositions Nos. 17 through 22 comprised aqueous dispersions of 26.5%, 31%, 35%, 42.5%, 47.5%, and 52% total solids volume, respectively, in 1% carboxymethyl hydroxypropyl guar. The total solids volume comprised 5% of a 4μ micro-particle by volume, and 95% of macro-particles of silica. The apparent viscosities of Sample Compositions 17 through 22 were determined to be 15, 17, 19, 25, 40, and 74 Pa-second, respectively.

Sample Compositions Nos. 23 through 26 comprised aqueous dispersions of 35%, 42.5%, 47.5%, and 52% total solids volume, respectively, in 1% carboxymethyl hydroxypropyl guar. The total solids volume comprised 10% of a 4μ micro-particle by volume, and 90% of macro-particles of silica. The apparent viscosities of Sample Compositions 23 through 26 were determined to be 13, 18, 24, and 44 Pa-second, respectively.

Sample Compositions Nos. 27 through 30 comprised aqueous dispersions of 35%, 42.5%, 47.5%, and 52% total solids volume, respectively, in 1% carboxymethyl hydroxypropyl guar. The total solids volume comprised 10% of a 4μ micro-particle by volume, and 90% of macro-particles of silica. The apparent viscosities of Sample Compositions 23 through 26 were determined to be 13, 18, 22, and 32 Pa-second, respectively.

The results of this testing are illustrated in FIG. 1.

The above example demonstrates, inter alia, that the compositions of the present invention comprising macro-particles and micro-particles demonstrate improved physical properties.

EXAMPLE 2

A 20/40 Brady sand having an average particle diameter of 490 microns, and found to have no detectable fines having particle diameters below 130 microns, was mixed with varying proportions of silica micro-particles having an average diameter of 4 microns. These sample compositions were tested to determine their residual stress and viscosity in a treatment fluid at different solids loadings. The testing was performed in the manner previously described for Example 1.

Sample Composition No. 27 comprised an aqueous dispersion of 45% total solids volume in 1% carboxymethyl hydroxylpropylguar. The total solids volume entirely comprised 20/40 Brady sand. The residual stress of Sample Composition No. 27 was measured to be 7.5 Pa. The viscosity of Sample Composition No. 27 was measured to be 40 Pa-second.

Sample Composition No. 28 comprised an aqueous dispersion of 50% total solids volume in 1% carboxymethyl hydroxylpropylguar. The total solids volume entirely comprised 20/40 Brady sand. The residual stress of Sample Composition No. 28 was measured to be 27.5 Pa. The viscosity of Sample Composition No. 28 was measured to be 83 Pa-second.

Sample Composition No. 29 comprised an aqueous dispersion of 55% total solids volume in 1% carboxymethyl hydroxylpropylguar. The total solids volume entirely comprised 20/40 Brady sand. The residual stress of Sample Composition No. 29 was measured to be 67.5 Pa. The viscosity of Sample Composition No. 29 was measured to be 150 Pa-second.

Sample Composition No. 30, a composition of the present invention, comprised an aqueous dispersion of 45% total solids volume in 1% carboxymethyl hydroxylpropylguar. The total solids volume comprised 97% 20/40 Brady sand by volume and 3% of a 4μ micro-particle by volume. The residual stress of Sample Composition No. 30 was measured to be 3.5 Pa. The viscosity of Sample Composition No. 30 was measured to be 31 Pa-second.

Sample Composition No. 31, a composition of the present invention, comprised an aqueous dispersion of 50% total solids volume in 1% carboxymethyl hydroxylpropylguar. The total solids volume comprised 97% 20/40 Brady sand by volume and 3% of a 4μ micro-particle by volume. The residual stress of Sample Composition No. 31 was measured to be 11 Pa. The viscosity of Sample Composition No. 31 was measured to be 61 Pa-second.

Sample Composition No. 32, a composition of the present invention, comprised an aqueous dispersion of 55% total solids volume in 1% carboxymethyl hydroxylpropylguar. The total solids volume comprised 97% 20/40 Brady sand by volume and 3% of a 4μ micro-particle by volume. The residual stress of Sample Composition No. 32 was measured to be 42 Pa. The viscosity of Sample Composition No. 32 was measured to be 107 Pa-second.

The results of this testing are set forth in tabular form below.

TABLE 1

| | Residual Stress of the Dispersion (Pa) | | |
|---|---|---|---|
| | 45% total solids volume | 50% total solids volume | 55% total solids volume |
| Dispersions of macro-particles of 20/40 Brady sand | 7.5 | 27.5 | 67.5 |
| Dispersions comprising 97% of 20/40 Brady sand and 3% of 4μ micro-particles | 3.5 | 11 | 42 |

TABLE 2

| | Viscosity of the Dispersion (Pa-second) | | |
|---|---|---|---|
| | 45% total solids volume | 50% total solids volume | 55% total solids volume |
| Dispersions of macro-particles of 20/40 Brady sand | 40 | 83 | 150 |
| Dispersions comprising 97% of 20/40 Brady sand and 3% of 4μ micro-particles | 31 | 61 | 107 |

The above example demonstrates, inter alia, that the compositions of the present invention comprising macro-particles and micro-particles demonstrate improved physical properties.

EXAMPLE 3

Sample compositions comprising aqueous dispersions of silica particles were sieved to produce macro-particles having diameters in the range of from about 177μ to about 300μ, e.g., containing no small particles ("fines"). Sample compositions were prepared that comprised dispersions of mixtures of micro-particles having an average diameter of 4μ and sieved silica macro-particles. The micro-particles and sieved silica macro-particles were mixed in the proportion of 97% sieved silica macro-particles and 3% micro-particles. The macro-particles and micro-particles were dispersed by hand, using a spatula, into a 1% solution of carboxymethyl hydroxylpropylguar until the dispersion was visibly uniform. The sample compositions were then tested according to the procedure set forth in Example 1.

Sample Composition No. 33 comprised an aqueous dispersion of 45% total solids volume in 1% carboxymethyl hydroxylpropylguar. The total solids volume entirely comprised sieved silica macro-particles. The residual stress of Sample Composition No. 33 was measured to be 4 Pa. The viscosity of Sample Composition No. 33 was measured to be 32 Pa-second.

Sample Composition No. 34 comprised an aqueous dispersion of 50% total solids volume in 1% carboxymethyl hydroxylpropylguar. The total solids volume entirely comprised sieved silica macro-particles. The residual stress of Sample Composition No. 34 was measured to be 22 Pa. The viscosity of Sample Composition No. 34 was measured to be 72 Pa-second.

Sample Composition No. 35 comprised an aqueous dispersion of 55% total solids volume in 1% carboxymethyl hydroxylpropylguar. The total solids volume entirely comprised sieved silica macro-particles. The residual stress of Sample Composition No. 35 was measured to be 117 Pa. The viscosity of Sample Composition No. 35 was measured to be 208 Pa-second.

Sample Composition No. 36, a composition of the present invention, comprised an aqueous dispersion of 45% total solids volume in 1% carboxymethyl hydroxylpropylguar. The total solids volume comprised 97% sieved silica macro-particles by volume and 3% of 4μ micro-particles by volume. The residual stress of Sample Composition No. 36 was measured to be 2 Pa. The viscosity of Sample Composition No. 36 was measured to be 25 Pa-second.

Sample Composition No. 37, a composition of the present invention, comprised an aqueous dispersion of 50% total solids volume in 1% carboxymethyl hydroxylpropylguar. The total solids volume comprised 97% sieved silica macro-particles by volume and 3% of 4μ micro-particles by volume. The residual stress of Sample Composition No. 37 was measured to be 6.5 Pa. The viscosity of Sample Composition No. 37 was measured to be 46 Pa-second.

Sample Composition No. 38, a composition of the present invention, comprised an aqueous dispersion of 55% total solids volume in 1% carboxymethyl hydroxylpropylguar. The total solids volume comprised 97% sieved silica macro-particles by volume and 3% of 4μ micro-particles by volume. The residual stress of Sample Composition No. 38 was measured to be 48 Pa. The viscosity of Sample Composition No. 38 was measured to be 121 Pa-second.

The results of this testing are set forth in tabular form below.

TABLE 3

| | Residual Stress of the Dispersion (Pa) | | |
|---|---|---|---|
| | 45% total solids volume | 50% total solids volume | 55% total solids volume |
| Dispersions of sieved macro-particles | 4 | 22 | 117 |
| Dispersions comprising 97% of sieved macro-particles and 3% of 4μ micro-particles | 2 | 6.5 | 48 |

TABLE 4

| | Viscosity of the Dispersion (Pa-second) | | |
|---|---|---|---|
| | 45% total solids volume | 50% total solids volume | 55% total solids volume |
| Dispersions of sieved macro-particles | 32 | 72 | 208 |
| Dispersions comprising 97% of sieved macro-particles and 3% of 4μ micro-particles | 25 | 46 | 121 |

The above example demonstrates, inter alia, that the compositions of the present invention comprising macro-particles and micro-particles demonstrate improved physical properties.

EXAMPLE 4

Sample Compositions comprising aqueous dispersions of unsieved silica macro-particles having an average diameter of about 177μ together with varying amounts of 4μ micro-particles were prepared by dispersing the powders by hand, using a spatula, into a 1% solution of carboxymethyl hydroxylpropylguar until the dispersion was visibly uniform. The sample compositions were then tested according to the procedure previously set forth in Example 1.

Sample Composition No. 39 comprised an aqueous dispersion of 48% total solids volume in 1% carboxymethyl hydroxylpropylguar. The total solids volume entirely comprised unsieved silica macro-particles. The residual stress of Sample Composition No. 39 was measured to be 7 Pa.

Sample Composition No. 40, a composition of the present invention, comprised an aqueous dispersion of 48% total solids volume in 1% carboxymethyl hydroxylpropylguar. The total solids volume comprised 99.5% unsieved silica macro-particles by volume, and 0.5% of 4μ micro-particles by volume. The residual stress of Sample Composition No. 40 was measured to be 7.5 Pa.

Sample Composition No. 41, a composition of the present invention, comprised an aqueous dispersion of 48% total solids volume in 1% carboxymethyl hydroxylpropylguar. The total solids volume comprised 99% unsieved silica macro-particles by volume, and 1% of 4μ micro-particles by volume. The residual stress of Sample Composition No. 41 was measured to be 6 Pa.

Sample Composition No. 42, a composition of the present invention, comprised an aqueous dispersion of 48% total solids volume in 1% carboxymethyl hydroxylpropylguar. The total solids volume comprised 97% unsieved silica macro-particles by volume and 3% of 4μ micro-particles by volume. The residual stress of Sample Composition No. 42 was measured to be 3 Pa.

Sample Composition No. 43, a composition of the present invention, comprised an aqueous dispersion of 48% total solids volume in 1% carboxymethyl hydroxylpropylguar. The total solids volume comprised 95% unsieved silica macro-particles by volume and 5% of 4μ micro-particles by volume. The residual stress of Sample Composition No. 43 was measured to be 2.5 Pa.

Sample Composition No. 44, a composition of the present invention, comprised an aqueous dispersion of 48% total solids volume in 1% carboxymethyl hydroxylpropylguar. The total solids volume comprised 90% unsieved silica macro-particles by volume and 10% of 4μ micro-particles by volume. The residual stress of Sample Composition No. 44 was measured to be 0.5 Pa.

Sample Composition No. 45, a composition of the present invention, comprised an aqueous dispersion of 48% total solids volume in 1% carboxymethyl hydroxylpropylguar. The total solids volume comprised 80% unsieved silica macro-particles by volume and 20% of 4μ micro-particles by volume. The residual stress of Sample Composition No. 45 was measured to be 0.5 Pa.

Sample Composition No. 46 comprised an aqueous dispersion of 52% total solids volume in 1% carboxymethyl hydroxylpropylguar. The total solids volume entirely comprised unsieved silica macro-particles. The residual stress of Sample Composition No. 46 was measured to be 46 Pa.

Sample Composition No. 47, a composition of the present invention, comprised an aqueous dispersion of 52% total solids volume in 1% carboxymethyl hydroxylpropylguar. The total solids volume comprised 99.5% unsieved silica macro-particles by volume, and 0.5% of 4μ micro-particles by volume. The residual stress of Sample Composition No. 47 was measured to be 32 Pa.

Sample Composition No. 48, a composition of the present invention, comprised an aqueous dispersion of 52% total solids volume in 1% carboxymethyl hydroxylpropylguar. The total solids volume comprised 99% unsieved silica macro-particles by volume, and 1% of 4μ micro-particles by volume. The residual stress of Sample Composition No. 48 was measured to be 31 Pa.

Sample Composition No. 49, a composition of the present invention, comprised an aqueous dispersion of 52% total solids volume in 1% carboxymethyl hydroxylpropylguar. The total solids volume comprised 97% unsieved silica macro-particles by volume and 3% of 4μ micro-particles by volume. The residual stress of Sample Composition No. 49 was measured to be 16 Pa.

Sample Composition No. 50, a composition of the present invention, comprised an aqueous dispersion of 52% total solids volume in 1% carboxymethyl hydroxylpropylguar. The total solids volume comprised 95% unsieved silica macro-particles by volume and 5% of 4μ micro-particles by volume. The residual stress of Sample Composition No. 50 was measured to be 12 Pa.

Sample Composition No. 51, a composition of the present invention, comprised an aqueous dispersion of 52% total solids volume in 1% carboxymethyl hydroxylpropylguar. The total solids volume comprised 90% unsieved silica macro-particles by volume and 10% of 4μ micro-particles by volume. The residual stress of Sample Composition No. 51 was measured to be 2.5 Pa.

Sample Composition No. 52, a composition of the present invention, comprised an aqueous dispersion of 52% total solids volume in 1% carboxymethyl hydroxylpropylguar. The total solids volume comprised 80% unsieved silica macro-particles by volume and 20% of 4μ micro-particles by volume. The residual stress of Sample Composition No. 52 was measured to be 1.5 Pa.

Figure 2:
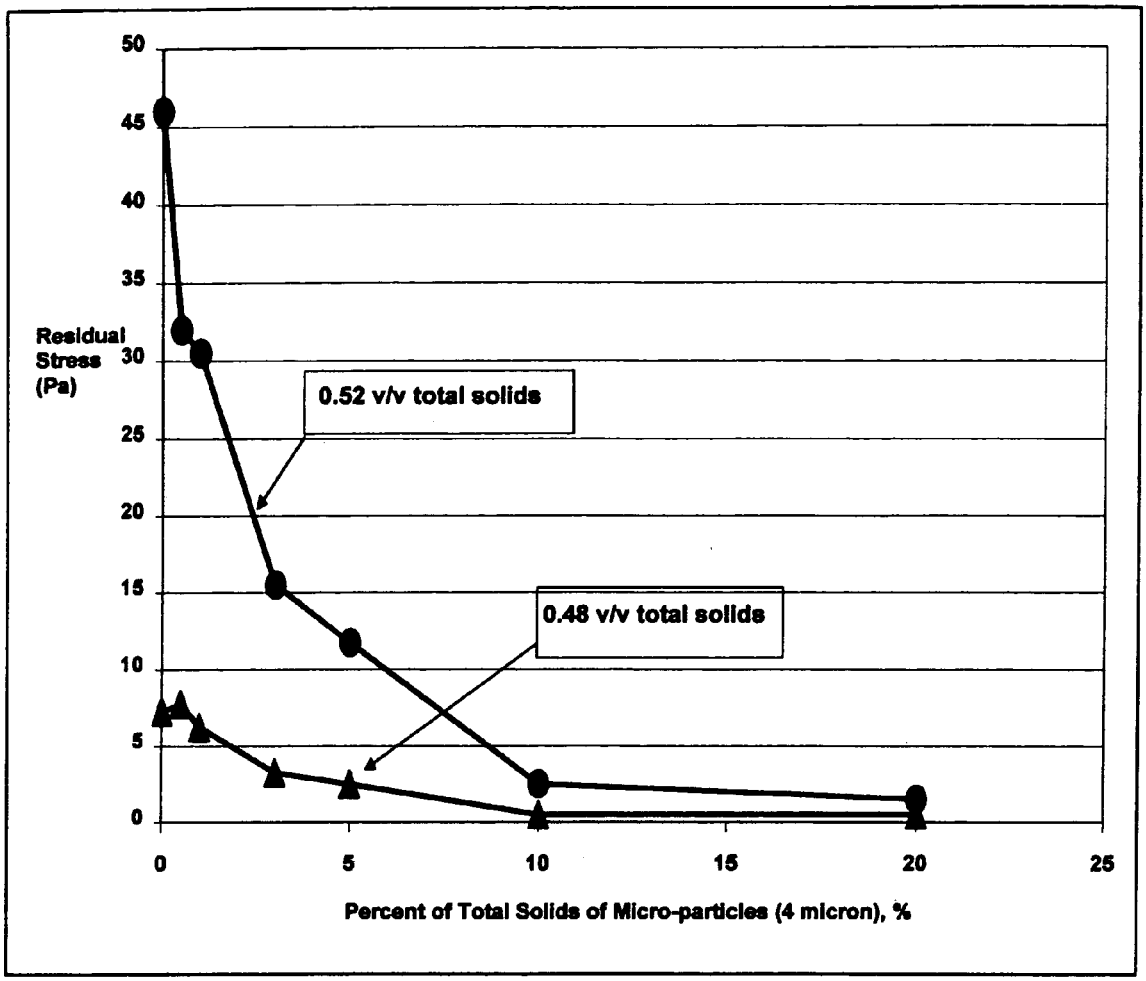
FIG. 2 is a graphical representation of the residual stress demonstrated by embodiments of treatment fluids that comprised only dispersions of macro-particles, and embodiments of treatment fluids of the present invention that comprised dispersions of both macro- and micro-particles.

The results of this testing are set forth in tabular form below, and in FIG. 2.

TABLE 5

| Composition of the Dispersion | Residual Stress of the Dispersion (Pa) | |
|---|---|---|
| Micro-Particle:Macro-Particle (Volume %) | 48% Total Solids Volume | 52% Total Solids Volume |
| 0:100 | 7 | 46 |
| 0.5:99.5 | 7.5 | 32 |
| 1:99 | 6 | 31 |
| 3:97 | 3 | 16 |
| 5:95 | 2.5 | 12 |
| 10:90 | 0.5 | 2.5 |
| 20:80 | 0.5 | 1.5 |

The above example demonstrates, inter alia, that the compositions of the present invention comprising macro-particles and micro-particles demonstrate improved physical properties.

Therefore, the present invention is well adapted to carry out the objects and attain the ends and advantages mentioned as well as those that are inherent therein. While the invention has been depicted and described by reference to embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are only, and are not exhaustive of the scope of the invention. Consequently, the invention is intended to be limited only by the spirit and scope of the appended claims, giving full cognizance to equivalents in all respects.

What is claimed is:

1. A method of fracturing a subterranean formation that comprises placing a treatment fluid comprising a liquid component and a solid component into a subterranean formation at a pressure sufficient to create or enhance at least one fracture therein, wherein:

the solid component comprises:

a portion of macro-particles; and a portion of micro-particles that have an average diameter at least about 20 times smaller than that of the macro-particles;

the portion of micro-particles comprises about 1% to about 20% of the total volume of the solid component; and the portion of macro-particles comprises about 80% to about 99% of the total volume of the solid component.

2. The method of claim 1 wherein the liquid component is a viscosified fluid.

3. The method of claim 1 wherein the liquid component is selected from the group consisting of foams, aqueous gels, oil-based gels, and emulsions.

4. The method of claim 1 wherein the macro-particles are selected from the group consisting of natural sand, quartz sand, particulate garnet, glass, ground walnut hulls, nylon pellet hulls, bauxite, ceramics, inorganic crystals, metal oxides, and combinations thereof.

5. The method of claim 1 wherein the micro-particles are selected from the group consisting of silica, alumina, calcite, inorganic crystals, metal oxides, and combinations thereof.

6. The method of claim 1 wherein the portion of micro-particles comprises about 1% to about 10% of the total volume of the solid component.

7. The method of claim 1 wherein the liquid component is present in the range of from about 45% to about 97% by volume of the treatment fluid.

8. The method of claim 1 wherein the solid component is present in the range of from about 3% to about 55% by volume of the treatment fluid.

9. The method of claim 1 wherein the treatment fluid further comprises an additive selected from the group consisting of breakers, stabilizers, clay stabilizers, fluid loss control additives, bactericides, and combinations thereof.

10. The method of claim 1 wherein the average diameter of the micro-particles is in the range of about 1 to about 5 microns.

* * * * *